US007598931B2

(12) United States Patent
Han

(10) Patent No.: US 7,598,931 B2
(45) Date of Patent: Oct. 6, 2009

(54) SCAN DRIVING CONTROL OF A PLASMA DISPLAY ACCORDING TO A PREDETERMINED DATA PATTERN

(75) Inventor: Jung Gwan Han, Gumi-si (KR)

(73) Assignee: LG Electronics Inc., Seoul (KR)

( * ) Notice: Subject to any disclaimer, the term of this patent is extended or adjusted under 35 U.S.C. 154(b) by 696 days.

(21) Appl. No.: 11/166,093

(22) Filed: Jun. 27, 2005

(65) Prior Publication Data

US 2006/0066515 A1 Mar. 30, 2006

(30) Foreign Application Priority Data

Sep. 30, 2004 (KR) ..... 10-2004-0078090

(51) Int. Cl.
*G09G 3/28* (2006.01)

(52) U.S. Cl. ..... 345/60

(58) Field of Classification Search ..... 345/60, 345/63, 690, 55, 169.2, 99, 100, 208, 209; 715/701, 702

See application file for complete search history.

(56) References Cited

U.S. PATENT DOCUMENTS

| | | | | |
|---|---|---|---|---|
| 5,757,343 | A * | 5/1998 | Nagakubo | 345/63 |
| 2001/0033263 | A1* | 10/2001 | Yamada et al. | 345/89 |
| 2001/0040536 | A1* | 11/2001 | Tajima et al. | 345/55 |
| 2003/0222592 | A1 | 12/2003 | Tsai et al. | |
| 2004/0012612 | A1* | 1/2004 | Chan et al. | 345/619 |
| 2004/0104907 | A1* | 6/2004 | Jeon | 345/204 |

FOREIGN PATENT DOCUMENTS

| | | |
|---|---|---|
| CN | 1432173 | 7/2003 |
| CN | 1658260 | 8/2005 |
| EP | 0 945 844 A | 9/1999 |
| JP | 11-282398 | 10/1999 |
| JP | 2002-023694 | 1/2002 |
| TW | 552576 | 9/2003 |
| TW | 200405068 | 4/2004 |
| WO | WO 01/82284 A | 11/2001 |

* cited by examiner

*Primary Examiner*—Chanh Nguyen
*Assistant Examiner*—Robert M Stone
(74) *Attorney, Agent, or Firm*—McKenna Long & Aldridge LLP

(57) ABSTRACT

A plasma display apparatus has scan electrodes, data electrodes intersecting the scan electrodes, and discharge cells disposed at the intersections of the scan electrodes and the data electrodes. A scan driving unit scans the scan electrodes. A data driving unit supplies a data signal to the data electrodes, and a control unit controls the scan driving unit and the data driving unit. The control unit detects data patterns of input data to detect the load of data, and controls the scan of the scan driving unit according to the load. As such, if the scan electrodes are divided into two or more groups and supplied with scan signals, variation in the polarity of data signals applied to the data electrodes can be minimized.

13 Claims, 10 Drawing Sheets

SCAN DRIVING CONTROL OF A PLASMA DISPLAY ACCORDING TO A PREDETERMINED DATA PATTERN

CROSS-REFERENCES TO RELATED APPLICATION

This application claims priority under 35 U.S.C. § 119(a) to Korean Patent Application No. 10-2004-0078090, filed on Sep. 30, 2004, the entire contents of which are hereby incorporated by reference.

BACKGROUND OF THE INVENTION

1. Field of the Invention

The present invention relates to a data control method and apparatus, and more particularly, to a data control method and apparatus in which the power consumed and heat generated in a data driving circuit can be reduced.

2. Background of the Related Art

There is a growing interest in flat panel display devices capable of reducing the weight and the volume of the display device as compared to a cathode ray tube ("CRT"). These flat panel display devices can include a liquid crystal display ("LCD"), a plasma display panel ("PDP"), a field emission display ("FED"), electro-luminescence ("EL"), and the like. These flat panel display devices supply a digital signal or analog data to the display panels.

Of these flat panel display devices, the PDP is adapted to display an image of characters or graphics using light-emitting phosphors excited by ultraviolet light of about 147 nm generated during the discharge of a gas, for example, He+Xe, Ne+Xe or He+Ne+Xe. A PDP can easily be made large and thin, and with the recent development of the relevant technology, it can provide great increases in image quality. Particularly, a three-electrode AC surface discharge type PDP has the advantages of lower driving voltage and longer product lifespan because wall charges accumulate on a surface upon discharge and the electrodes are protected from sputtering caused by discharge.

The three-electrode AC surface discharge type PDP is driven with one frame being time-divided into a plurality of sub-fields each having a different number of discharge in order to implement the gray scale of an image. Each of the sub-fields is divided into a reset period for uniformly generating discharge, an address period for selecting a discharge cell, and a sustain period for implementing the gray level according to the number of discharges. To display an image with a gray scale of 256, a frame period corresponding to 1/60 seconds (16.67 ms) is divided into eight sub-fields SF1 to SF8, as shown in FIG. 1. Each of the sub-fields SF1 to SF8 is subdivided into the reset period, the address period, and the sustain period, as described above. The reset period and the address period of each of the sub-fields SF1 to SF8 are the same in every sub-field, and the sustain period and the frequency of its discharge number increase by the ratio of $2^n$ (n=0, 1, 2, 3, 4, 5, 6, 7) in each sub-field. Accordingly, as the sustain period varies in every sub-field, the gray scale of an image can be implemented.

In a PDP, however, since a driving voltage is relatively high due to a discharge characteristic that causes discharge to occur between two electrodes and the large size of the panel, the resulting power consumption is relatively high. Furthermore, a driver integrated circuit ("IC") for driving data electrodes and scan electrodes of the PDP must supply a high voltage to electrodes Y, Z and X, respectively, in order to generate discharge. Therefore, the power consumed and heat generated are relatively high.

In a PDP, power is primarily consumed in the sustain period and secondarily consumed in the address period. For example, the sustain period requires several hundreds of watts, and the address period requires several tens of watts. Power consumption of the sustain period primarily depends upon the efficiency of the PDP. Power consumption of the address period primarily depends upon a capacitance value C and voltage V of the PDP and the switching number of the driver IC.

The capacitance C of the PDP includes a capacitance C1 between data electrodes X1 to Xn, a capacitance C2 between the data electrodes X1 to Xn and scan electrodes Y1 to Ym, a capacitance C3 between the scan electrodes Y1 to Ym and a common sustain electrode Z, and a capacitance C4 between the address electrodes X and the common sustain electrode Z, as shown in FIG. 2. At least 90% of power consumed during the address period is a result of a displacement current occurring upon the charging/discharging of a PDP. The amount of the power consumed during the address period, which is generated by the displacement current, can be expressed by the following Equation 1:

$$P=IV=CV2f \quad (1)$$

wherein I is current, V is voltage of a data pulse, C is a capacitance value between the address electrode X and other electrodes Y, Z adjacent to the electrode X, and f is an average switching number per time of a data driver IC expressed as a frequency.

As such, if an energy recovery circuit is adapted in the data driver IC, the power consumption of the data driver IC can be expressed by the following Equation 2:

$$P=IV=CV2f(1-\alpha) \quad (2)$$

wherein $\alpha$ is energy recovery efficiency by an energy recovery circuit. In the data driver IC, the energy recovery efficiency $\alpha$ is about 0.5 maximum.

As can be seen from Equations 1 and 2, methods for reducing the power consumed during the address period can include lowering the number of charging/discharging to lower displacement current I, lowering data voltage V, lowering capacitance C of a PDP, reducing the switching number f of a data driver IC, and the like. Lowering data voltage V, however, is a limited solution because the voltage can generate discharge in a discharge cell. Further, lowering capacitance C of a PDP is also a limited solution because the PDP has been developed toward higher resolution with a larger screen.

The switching number f of the data driver IC is highest when the data pattern has a logic High and a logic Low alternating in the discharge cells in both a column direction and a row direction, as shown in FIG. 3. In other words, the data pattern shown in FIG. 3 requires the data driver IC to repeatedly turn on and off a switching element every horizontal period.

If the switching element of the data driver IC repeatedly turns on and off every horizontal period, there are problems in that the power consumed is high and heat is generated in the data driver IC. Actually, if the data pattern as shown in FIG. 3 is consistently supplied for an extended time, extreme heat can be generated in the data driver IC, and the data driver IC can be damaged.

Moreover, the switching number f of the data driver IC is high when voltages of the same logic level are applied to two adjacent discharge cells 10, as shown in FIG. 4. In this pattern, a logic High and a logic Low alternate in discharge cells in a row direction and alternate in groups of two discharge cells in a column direction. In other words, the data driver IC repeats turning on and off a switching element every two horizontal periods for the data pattern, as shown in FIG. 4. Accordingly, the power consumed is high and too much heat is generated.

In addition, the capacitance C of a PDP is also high as a result of the data patterns shown in FIGS. 3 and 4. As can be seen from the above, in the data patterns shown in FIGS. 3 and 4, the capacitance of a PDP and the switching number of a data driver IC are both high. Therefore, since the displacement current is high, the power consumed and heat generated are relatively high.

SUMMARY OF THE INVENTION

Accordingly, in view of the problems occurring in the prior art, it is one advantage of the present invention to provide a data control method and apparatus in which power consumption and heat generated in a data driving circuit can be reduced. Additional or alternative advantages are also possible.

According to one embodiment of the present invention, a plasma display apparatus can include scan electrodes, data electrodes intersecting the scan electrodes, and discharge cells disposed at the intersections of the scan electrodes and the data electrodes. A scan driving unit scans the scan electrodes. A data driving unit supplies a data signal to the data electrodes, and a control unit controls the scan driving unit and the data driving unit. The control unit detects predetermined data patterns of input data to detect the data load, and controls the scan of the scan driving unit according to the load.

The control unit can include a data pattern detection unit that detects the data patterns of the input data; a data load detection unit that detects the data load of predetermined data patterns among the data patterns detected in the data pattern detection unit; a waveform generator that controls the scan sequence of the scan electrodes under the control of the data load detection unit; and a data alignment unit that realigns the data provided to the data electrodes based on the scan sequence.

The control unit can detect, among other patterns, at least a first data pattern in which a high level and a low level alternate in both a column direction and a row direction of the discharge cells, and a second data pattern in which a high level and a low level alternate in a row direction and alternate in groups of two discharge cells in the column direction.

The control unit controls the scan driving unit to scan the scan electrodes in a first scan sequence if the data provided as the first data pattern exceed a first reference point among the total data supplied to one screen, and controls the scan driving unit to scan the scan electrodes in a second scan sequence if the data supplied as the second data pattern exceed a second reference point among the total data supplied to one screen. The second scan sequence can be different from the first scan sequence, and the second reference point can be different from the first reference point. The amount of data of a particular pattern expressed as a percentage of the total data is referred to as the "data load."

The first reference point can be set to 25%.

The second reference point can be set to 50%.

The first scan sequence is a sequence in which the scan electrodes are divided into two groups and then scanned, and the second scan sequence is a sequence in which the scan electrodes are divided into four groups and then scanned.

In the first scan sequence, the scan electrodes are divided into a first group including odd-numbered scan electrodes, and a second group including even-numbered scan electrodes.

In the first scan sequence, the odd-numbered scan electrodes included in the first group are sequentially scanned, and the even-numbered scan electrodes included in the second group are sequentially scanned.

In the second scan sequence, the scan electrodes are divided into a first group including $i^{th}$ (i is 1,5,9,13, . . . m) scan electrodes, a second group including $(i+1)^{th}$ scan electrodes, a third group including $(i+2)^{th}$ scan electrodes, and a fourth group including $(i+3)^{th}$ scan electrodes.

In the second scan sequence, the scan electrodes included in the first group are sequentially scanned; the scan electrodes included in the second group are sequentially scanned; the scan electrodes included in the third group are sequentially scanned; and the scan electrodes included in the fourth group are sequentially scanned.

The data patterns can be detected for every sub-field.

According to another embodiment of the present invention, a plasma display apparatus can include scan electrodes, data electrodes intersecting the scan electrodes, a scan driving unit that scans the scan electrodes in a scan sequence in dependence of the data load of at least two scan electrodes, and a data driving unit that supplies a data signal corresponding to the scan to the data electrodes.

According to still another embodiment of the present invention, a plasma display apparatus can include scan electrodes, data electrodes intersecting the scan electrodes, discharge cells disposed at the intersections of the scan electrodes and the data electrodes, a scan driving unit that scans the scan electrodes in at least two scan sequences according to the ratio in which predetermined data patterns are included in data patterns of data that are input to the discharge cells, and a data driving unit that supplies a data signal corresponding to the scan to the data electrodes.

According to yet another embodiment of the present invention, there is provided a method of driving a plasma display apparatus that includes scan electrode and data electrodes intersecting the scan electrodes. The method can include the steps of scanning the scan electrodes in a scan sequence depending upon the data load of at least two scan electrodes, and supplying a data signal corresponding to the scan to the data electrodes.

According to still another embodiment of the present invention, there is provided a method of driving a plasma display apparatus that includes scan electrodes, data electrodes intersecting the scan electrodes, and discharge cells disposed at the intersections of the scan electrodes and the data electrodes. The method includes the steps of scanning the scan electrodes in at least two scan sequences according to the ratio in which predetermined data patterns are included in data patterns of data that are input to the discharge cells, and supplying a data signal corresponding to the scan to the data electrodes.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

Figure 5:
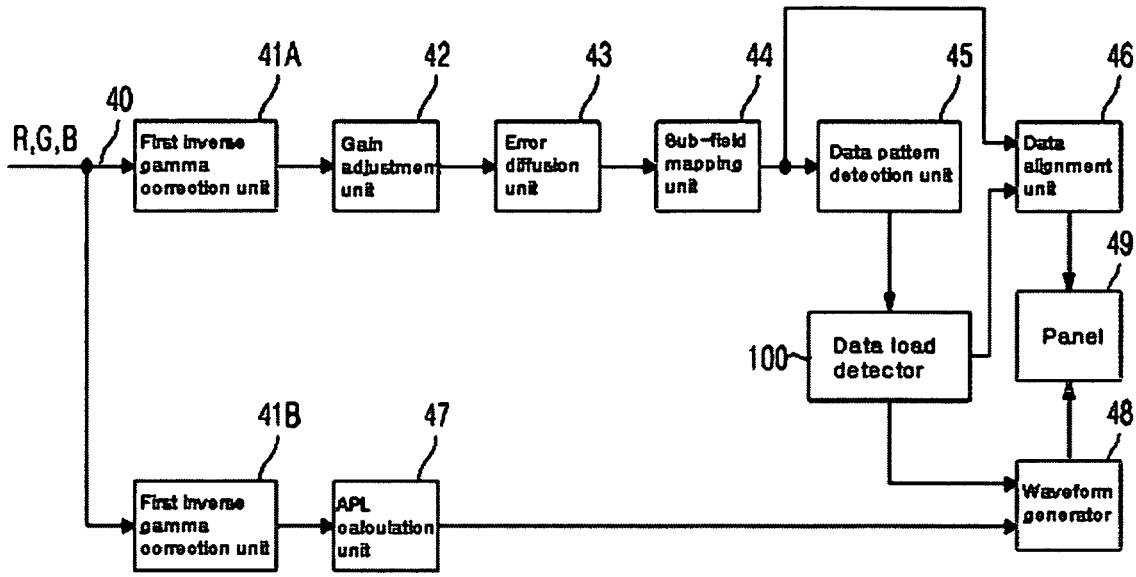
FIG. 5 is a block diagram illustrating a data control unit according to an embodiment of the present invention.

FIG. 5 is a block diagram illustrating a data control unit according to one embodiment of the present invention.

Referring to FIG. 5, an illustrated apparatus for driving a plasma display panel according to an embodiment of the present invention includes a gain controller 42, an error diffusion unit 43, a sub-field mapping unit 44 and a data pattern detector 45, all of which are connected between a first inverse gamma correction unit 41A and a data alignment unit 46. The illustrated apparatus further includes an APL calculator 47 connected between a second inverse gamma correction unit 41B and a waveform generator 48; a panel 49 connected between the data alignment unit 46 and the waveform generator 48; and a data load detector 100 connected between the data pattern detector 45, the waveform generator 48, and the data alignment unit 46. The control unit of the present invention does not necessarily include all of the above-mentioned components. Moreover, some of the components can be separate from the control unit or have multiple functions.

The first and second inverse gamma correction units 41A, 41B perform an inverse gamma correction operation on the digital video data RGB input from an input line 40, thereby linearly converting a brightness for a gray scale value of a picture signal.

The gain controller 42 compensates for color temperature by controlling a valid gain for every red, green and blue data.

The error diffusion unit 43 finely controls the brightness value of the digital video data RGB input from the gain controller 42 by diffusing the quantization error of the video data RGB toward neighboring cells.

The sub-field mapping unit 44 maps data input from the error diffusion unit 43 to a predetermined sub-field pattern on a bit basis, and supplies the mapping data to the data pattern detector 45.

Figure 1:
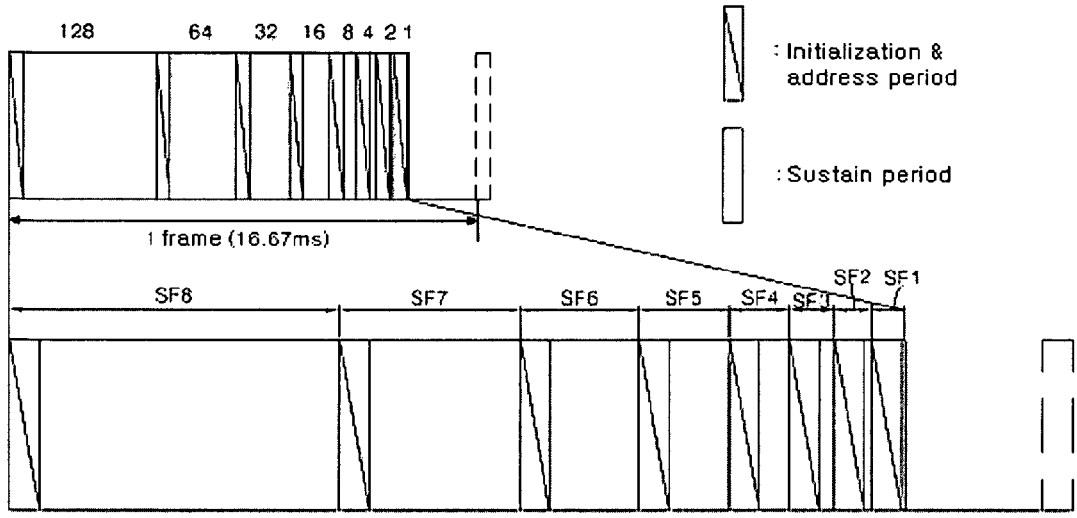
FIG. 1 shows a frame of a conventional PDP.
Figure 2:
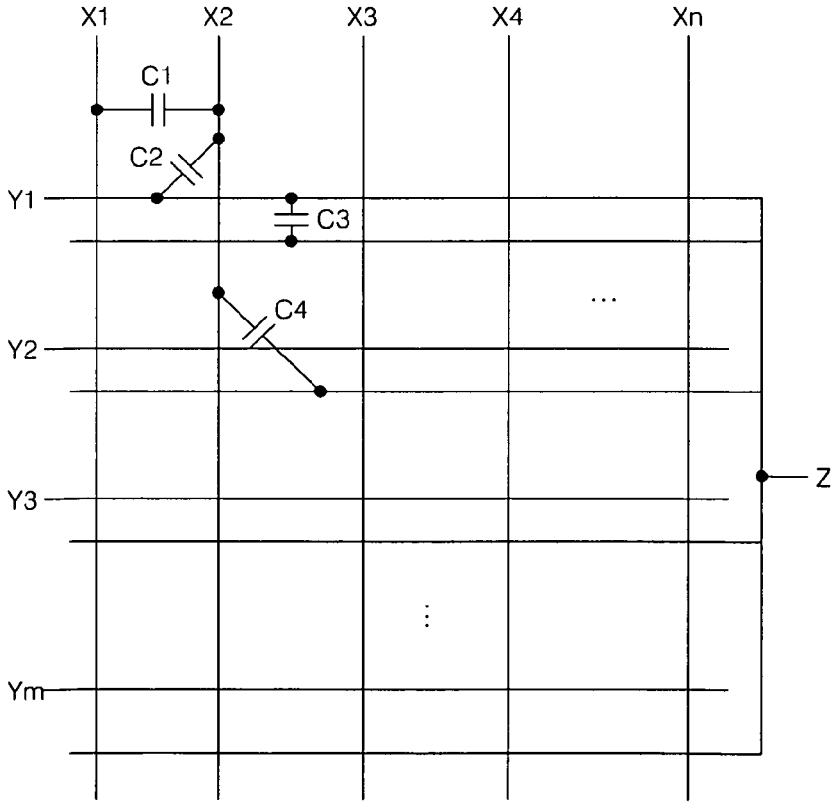
Fig. 2 Related Art
FIG. 2 is an equivalent circuit diagram showing the capacitance of a PDP.
Figure 3:
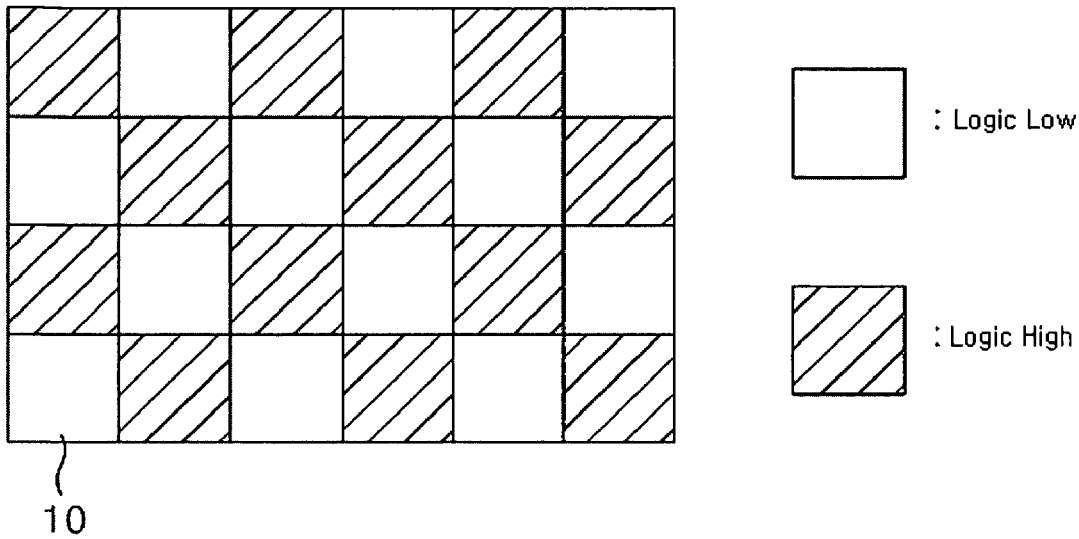
FIGS. 3 and 4 schematically show data patterns.
Figure 4:
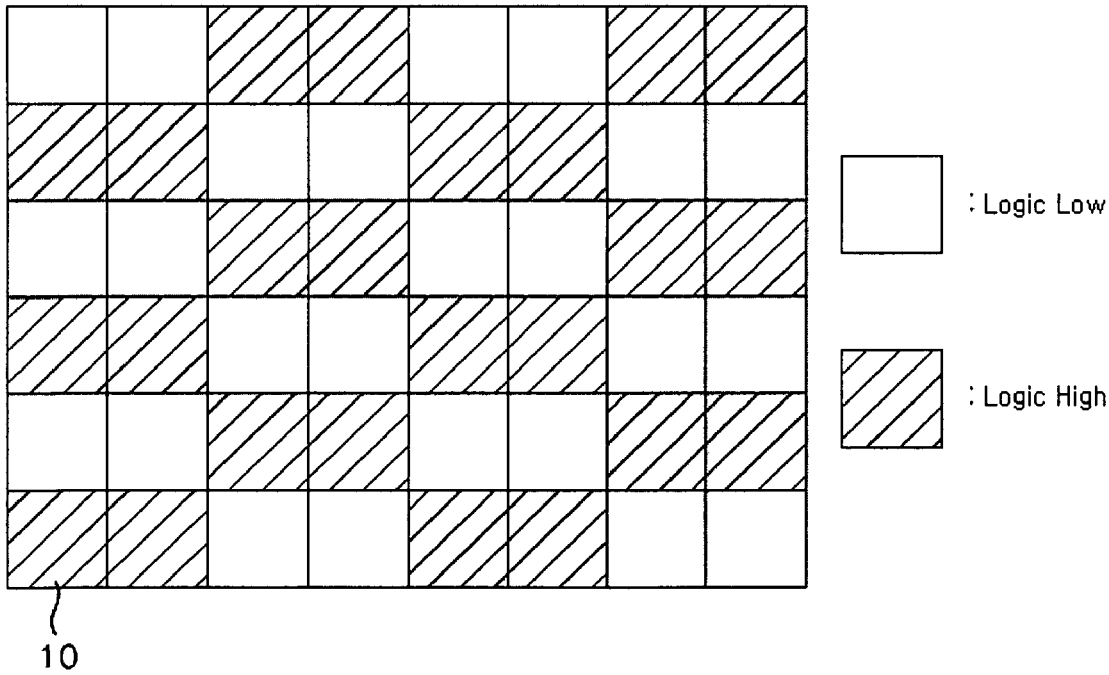
Fig. 4 Related Art

The data pattern detector 45 detects a data pattern every sub-field using the mapping data, and supplies a control signal corresponding to the detected data pattern to the data load detector 100. In this embodiment, the data pattern detector 45 determines whether the data pattern is a data pattern in which a logic High and a logic Low alternate in both a column direction and a row direction of a discharge cell ("a first data pattern"), as shown in FIG. 3, or a data pattern where a logic High and a logic Low alternate in a row direction and alternate in groups of two in a column direction ("a second data pattern"), as shown in FIG. 4. Alternative first and second data patterns can also be detected.

The data load detector 100 supplies the control signal, which corresponds to the data pattern output from the data pattern detector 45, to the waveform generator 48 and the data alignment unit 46.

The waveform generator 48 controls a scan sequence such that it corresponds to the control signal output from the data load detector 100. The scan sequence can be set differently for every sub-field corresponding to the control signal output from the data load detector 100.

The data alignment unit 46 provides the digital video data input from the sub-field mapping unit 44 to a data driving unit of the panel 49. At this time, the data alignment unit 46 controls the sequence of data provided according to the control signal supplied from the data load detector 100. In other words, the data alignment unit 46 supplies data such that it corresponds to the scan sequence determined in the waveform generator 48. One possible detailed operational process of the data pattern detector 45, the data load detector 100, the waveform generator 48 and the data alignment unit 46 is described below.

The APL calculator 47 calculates an average brightness on a screen basis picture level for the digital video data RGB input from the second inverse gamma correction unit 41B, i.e., an average picture level ("APL"), and then outputs information on the number of sustain pulses, which corresponds to calculated APL.

The waveform generator 48 generates a timing control signal according to the number of sustain pulses from the APL calculator 47, and supplies the timing control signal to the panel 49.

Figure 6:
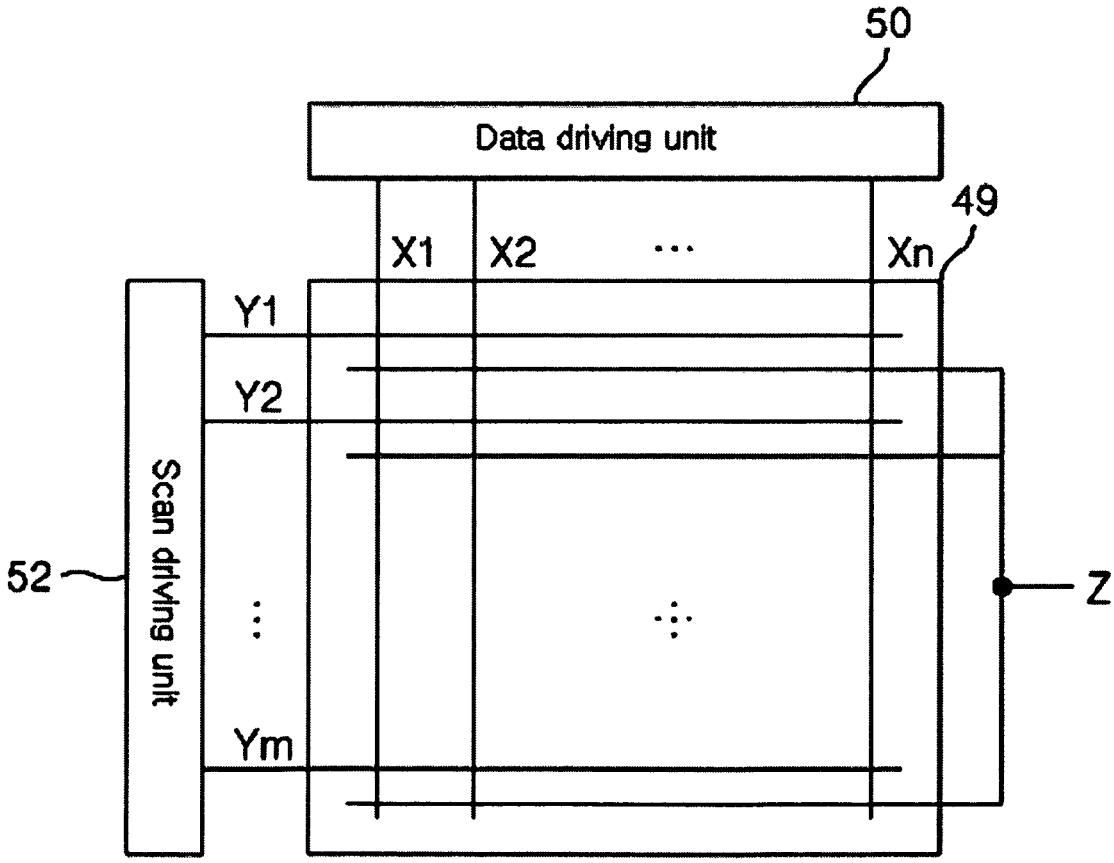
FIG. 6 is a diagram showing a driving apparatus connected to a display panel.

The panel 49 displays an image corresponding to data supplied from the data alignment unit 46. As shown in FIG. 6, the panel 49 is connected a data driving unit 50 and a scan driving unit 52.

Referring to FIG. 6, the data driving unit 50 converts data, which are aligned in the data alignment unit 46, into data signals, and supplies the converted data signals to data electrodes X1 to Xn. The scan driving unit 52 supplies scan pulses to scan electrodes Y1 to Ym according to the control signal supplied from the waveform generator 48. At this time, the scan driving unit 52 can divide the scan electrodes Y1 to Ym into two or more groups according to the control signal output from the waveform generator 48, and sequentially provides the scan pulses to the divided groups.

Figure 7:
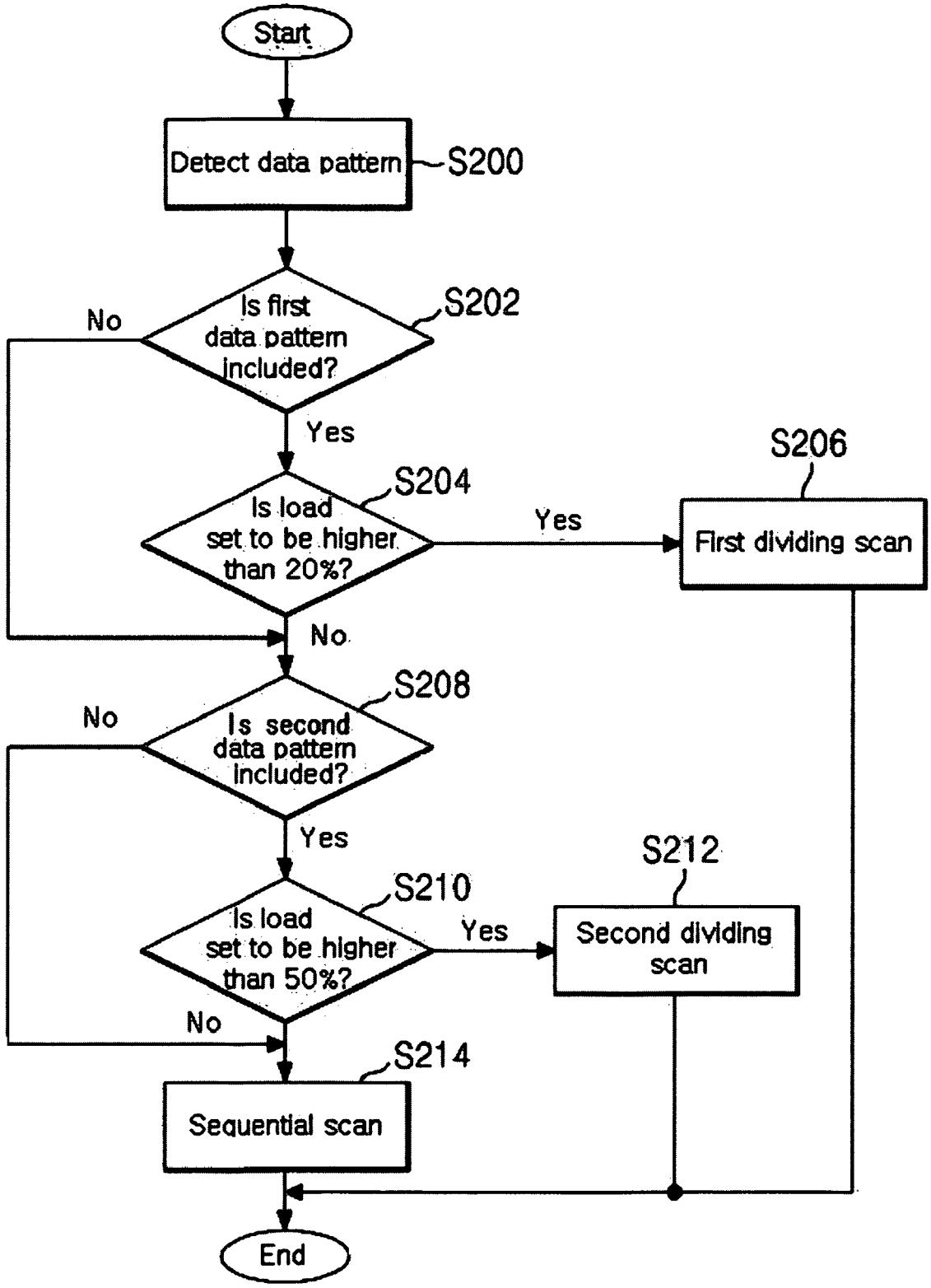
FIG. 7 is a flowchart illustrating a data control method according to an embodiment of the present invention.

One operational process of the apparatus for driving the PDP according to the present invention is described in detail in conjunction with FIG. 7, which is a flowchart illustrating a data control method according to an embodiment of the present invention.

Referring to FIG. 7, the data pattern detector 45 detects a data pattern for each sub-field using the mapping data output from the sub-field mapping unit 44 (S200). At this time, the data pattern detector 45 determines whether a first data pattern is included on a sub-field basis (S202).

If it is determined that the first data pattern is included in step S202, the data load detector 100 detects the load of the first data pattern. In other words, the data load detector 100 detects the load of data, which will be supplied in the form of the first data pattern among other data supplied to the sub-fields, and determines whether the detected load is higher than a first reference point among the total data to be supplied to at least a portion of the screen (S204). One example of a possible first data pattern is shown in FIG. 3. One criterion for setting the first reference point is the point at which the data load of the first data pattern results in a relatively high power consumption. Other criteria are also possible.

In this case, the first reference point can be set to 25%. For this embodiment, experiments demonstrate that if at least 25% of the data to be supplied to the sub-fields is supplied as the first data pattern, power consumption is high. It is, however, to be understood that the first reference point is not limited to 25%, but can vary within a predetermined range depending upon the driving environment of an actual panel. For example, the first reference can be set to 20%.

If data to be supplied as the first data pattern is higher than the first reference point in step S204, the data load detector 100 provides a first control signal to the data alignment unit 46 and the waveform generator 48.

The waveform generator 48 that receives the first control signal controls the scan driving unit 52 such that the scan electrodes Y1 to Ym are supplied with the scan pulses in which the scan electrodes are divided into two groups. In one possible scan sequence, for the first data pattern, the scan driving unit 52 provides the scan pulses to the scan electrodes Y1 to Ym with the scan electrodes being divided into odd-numbered scan electrodes (Y1, Y3, Y5, . . . ), and even-numbered scan electrodes (Y2, Y4, Y6, . . . ), under the control of the waveform generator 48, as shown in FIGS. 8*a* and 8*b* (first dividing scan S206).

The data alignment unit 46 that receives the first control signal aligns data such that they correspond to the scan sequence, and supplies the aligned data to the data driving unit 50. In other words, the data alignment unit 46 provides corresponding data to the data driving unit 50 when the scan pulses are supplied to the odd-numbered scan electrodes (Y1, Y3, Y5, . . . ), and corresponding data to the data driving unit 50 when the scan pulses are supplied to the even-numbered scan electrodes (Y2, Y4, Y6, . . . ). The data driving unit 50 converts the data supplied from the data alignment unit 46 into data signals, and provides the converted data signals to the data electrodes X1 to Xn.

Figure 8A:
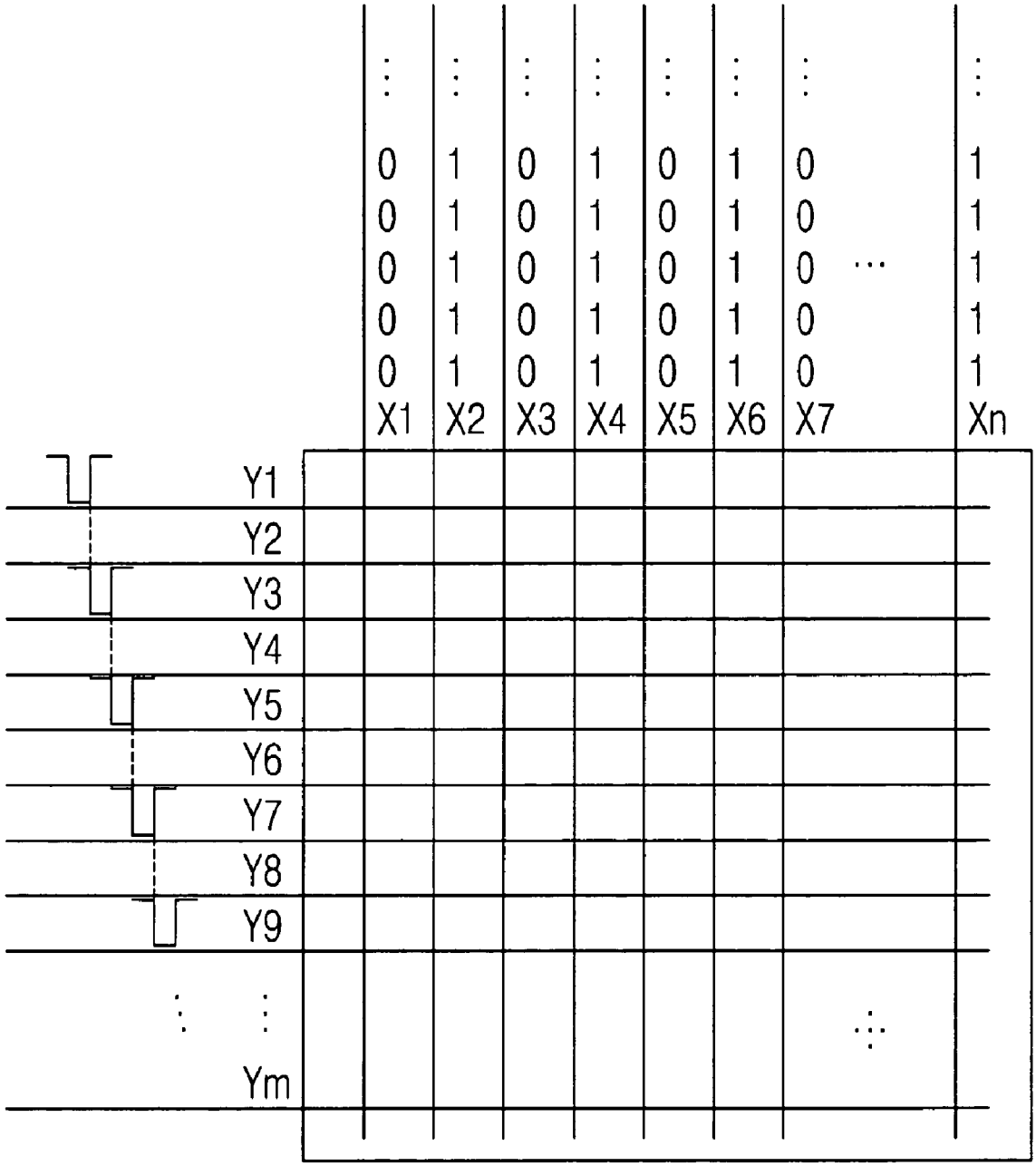
FIGS. 8*a* and 8*b* are views for explaining the operational process of the data control unit for the data pattern shown in FIG. 3.
Figure 8B:
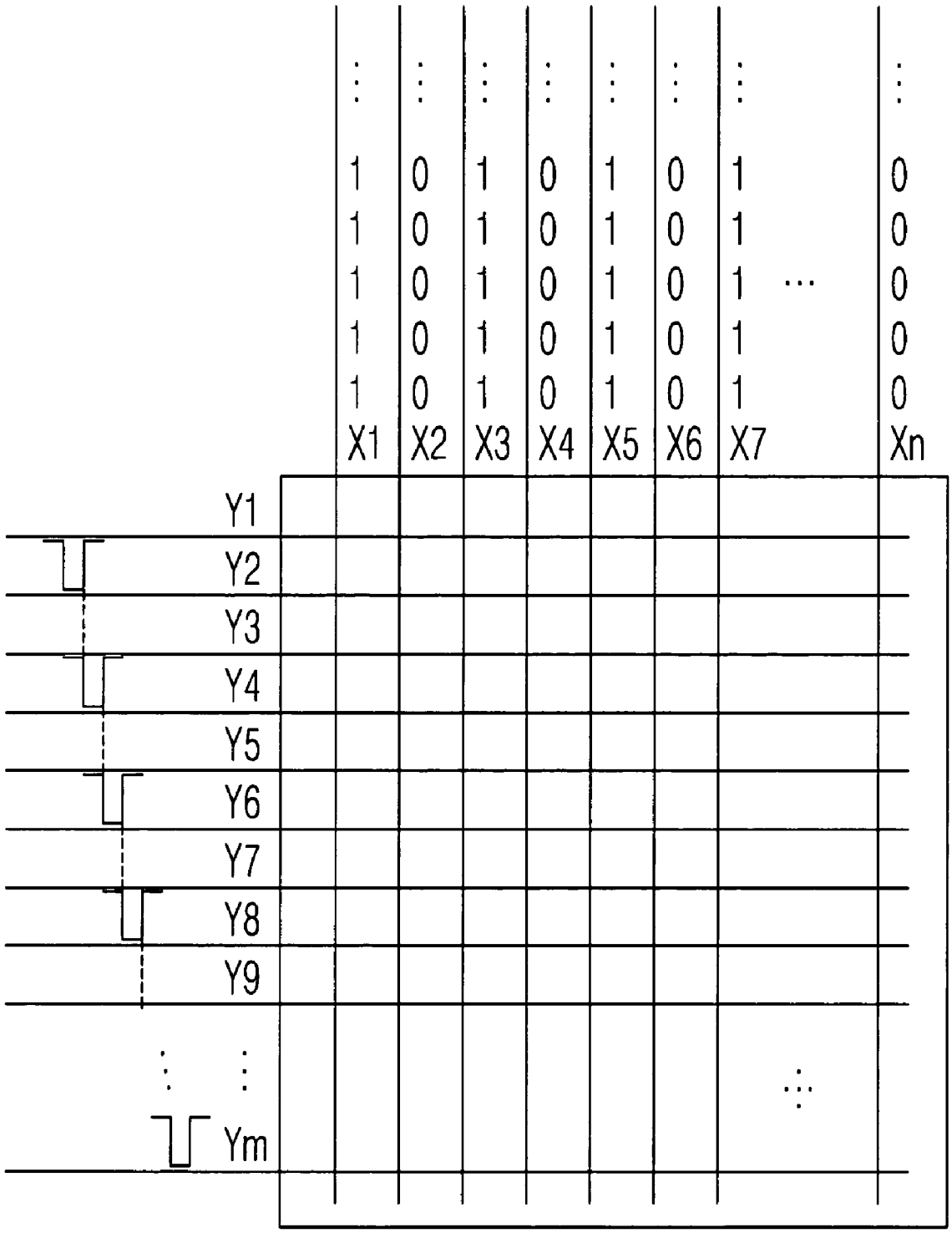
Figure 9A:
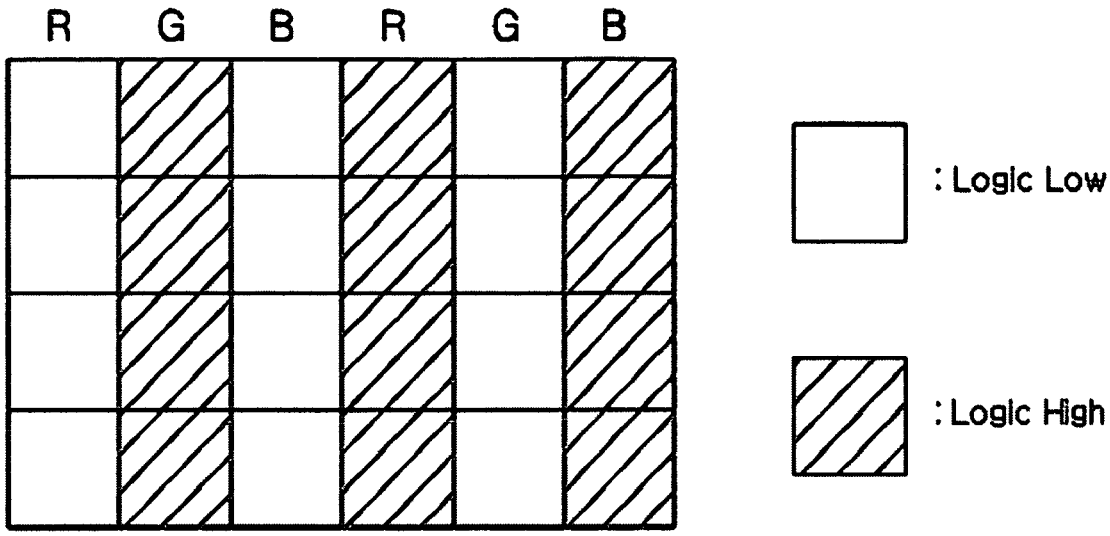
FIGS. 9*a* and 9*b* illustrate the polarity of data supplied to the panel for the operational process shown in FIGS. 8*a* and 8*b;*
Figure 9B:
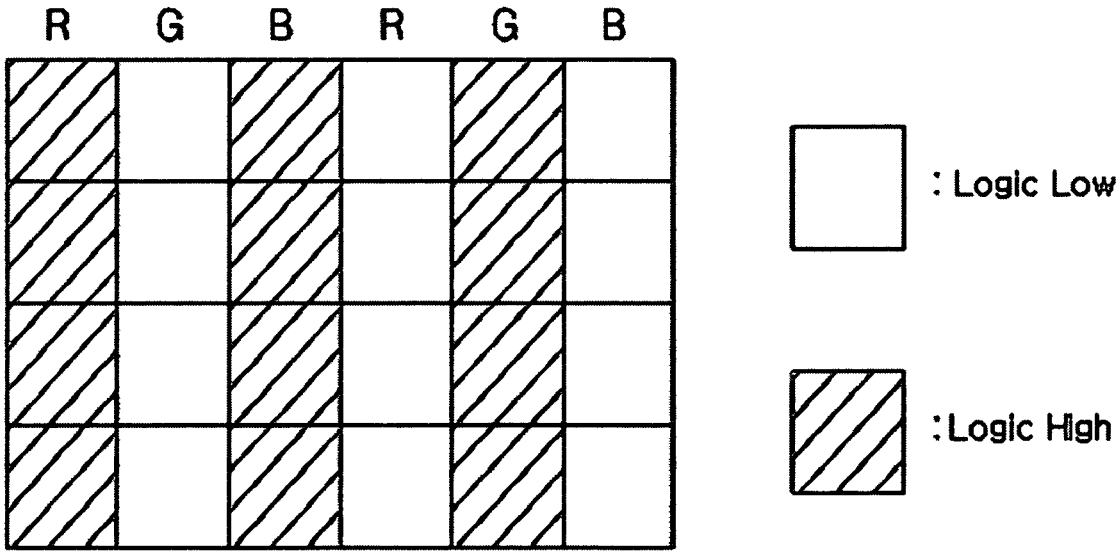
Figure 10A:
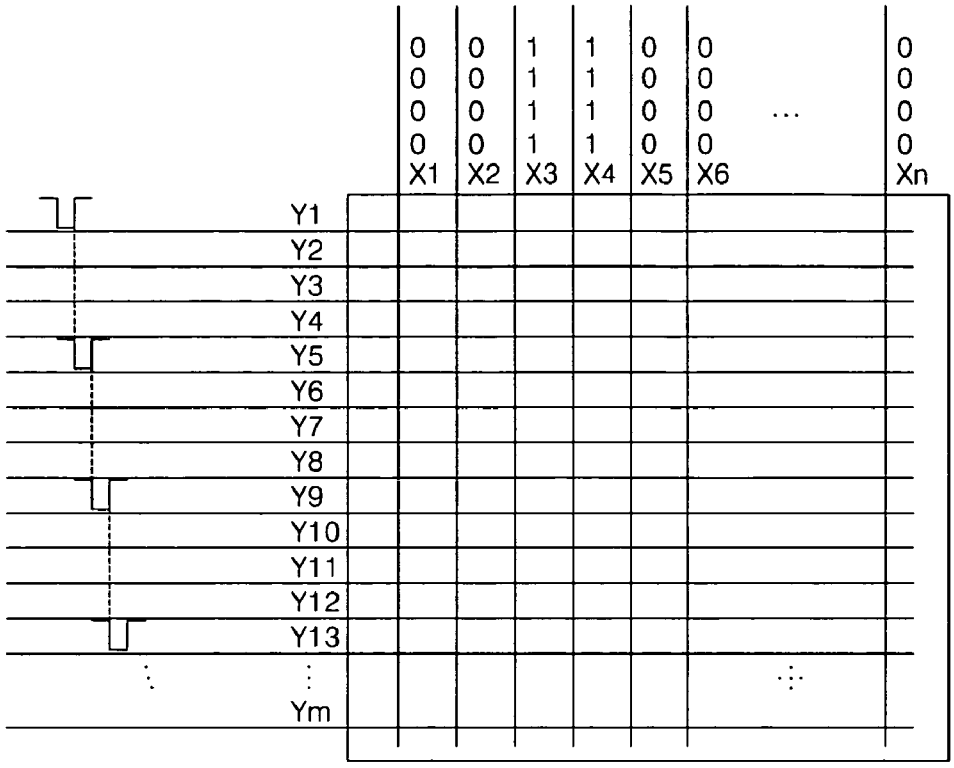
FIGS. 10*a* to 10*d* are views for explaining the operational process of the data control unit for the data pattern shown in FIG. 4.
Figure 10B:
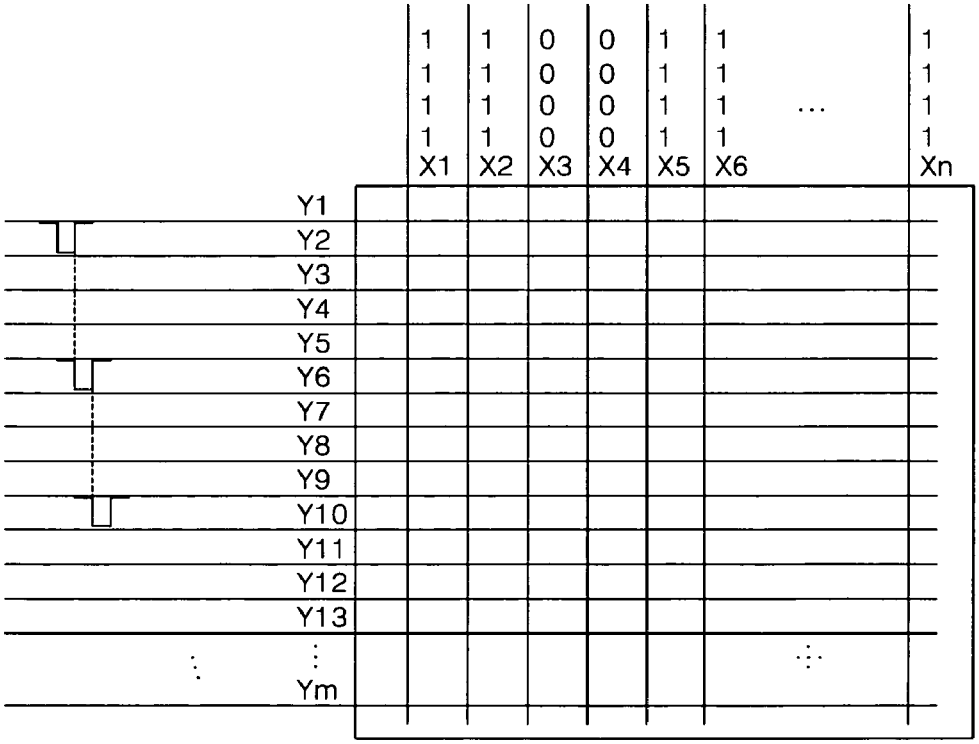
Figure 10C:
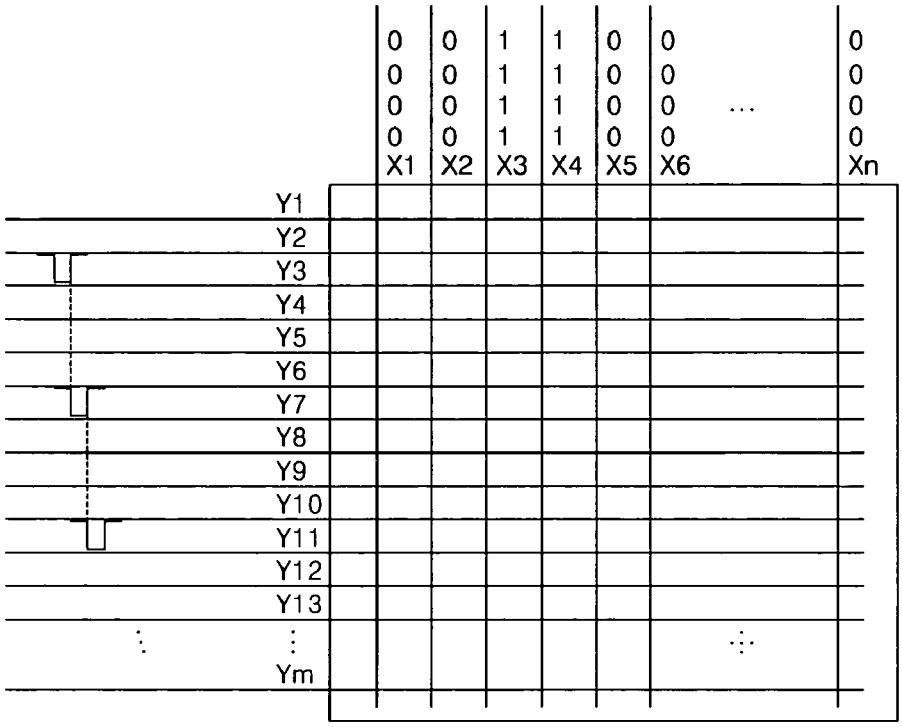
Figure 10D:
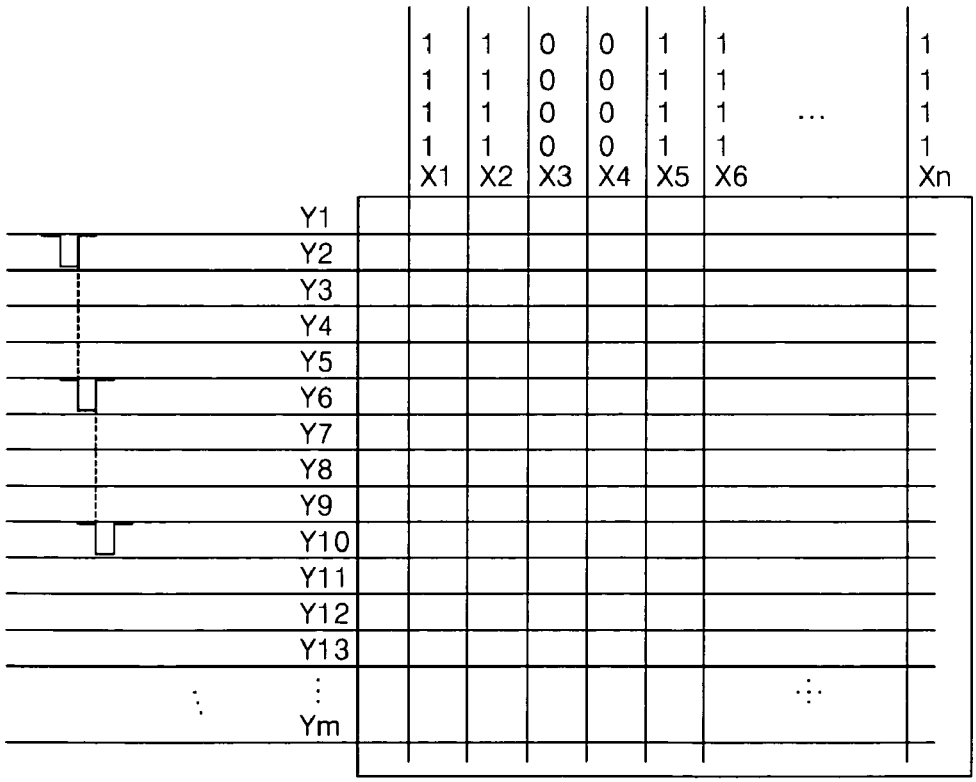

Accordingly, as shown in FIG. 8*a*, when the odd-numbered scan electrodes (Y1, Y3, Y5, . . . ) are supplied with the scan pulses, the data electrodes X1 to Xn are respectively supplied with the data signals of the same polarity. Furthermore, as shown in FIG. 8*b*, when the even-numbered scan electrodes (Y2, Y4, Y6, . . . ) are supplied with the scan pulses, the data electrodes X1 to Xn are respectively supplied with the data signals of the same polarity. That is, in the present invention, as shown in FIGS. 9*a* and 9*b*, during the period in which the scan pulses are supplied to the odd-numbered scan electrodes (Y1, Y3, Y5, . . . ) and the even-numbered scan electrodes (Y2, Y4, Y6, . . . ), the polarity of the data signals is not changed with every horizontal signal, as would be required in a strictly sequential scan. Instead, the polarity can be maintained through the even-numbered scan electrodes, then changed, and maintained through the odd-numbered scan electrodes. As such, it is possible that the polarity of the data signals supplied to the data electrodes X1 to Xn is changed only when the scan pulses are provided to the first even-numbered scan electrode Y2 after being supplied to the last odd-numbered scan electrode Ym−1. In this case, however, after the scan pulses are applied to the even-numbered scan electrodes, it can be supplied to the odd-numbered scan electrodes. Thus, even when the scan pulses are provided to the first odd-numbered scan electrode Y1 after being supplied to the last even-numbered scan electrode Ym, the polarity of the data signals will be changed.

Accordingly, in the present invention, it is possible for the switching elements of the data driving unit 50 to be maintained at the same on or off state during the period in which the scan pulses are supplied to all the odd-numbered scan electrodes (Y1, Y3, Y5, . . . ) and during the period in which the scan pulses are provided to all the even-numbered scan electrodes (Y2, Y4, Y6, . . . ). Accordingly, high power consumption and heat in the data driving unit 50 can be prevented or reduced.

Meanwhile, if the first data pattern is not detected in step S202, or if the first data pattern is determined to be lower than the first reference point in step S204, the data pattern detector 45 determines whether the second data pattern is included on a sub-field basis (S208). In this embodiment, the second data pattern is the data pattern shown in FIG. 4, although other data patterns are possible. If it is determined that the second data pattern is included in step S208, the data load detector 100 detects the load of the second data pattern. In other words, the data load detector 100 detects the load of data of the second data pattern among the total data supplied to the at least a portion of the screen, and determines whether the detected load is higher than a second reference point (S210). As in the first reference point, one criterion for setting the second reference point is the point at which the data load of the second data pattern results in relatively high power consumption. However, other criteria are possible, and the criteria for setting the second reference point does not have to be the same as the first reference point.

In this example, the second reference can be set to 50%. In this embodiment, experiments demonstrate that if at least 50% of the data supplied to the sub-fields is supplied as the second data pattern, the power consumed is relatively high. It is, however, to be understood that the second reference point is not limited to 50%, but can vary within a predetermined range depending upon driving environment of the actual panel. For example, the second reference point can be set to 40%.

If it is determined that the data supplied as the second data pattern are higher than the second reference point in step S210, the data load detector 100 supplies a second control signal to the data alignment unit 46 and the waveform generator 48.

The waveform generator 48 that receives the second control signal controls the scan driving unit 52 such that the scan electrodes Y1 to Ym are supplied with the scan pulses with the scan electrodes being divided into four groups. Under the control of the waveform generator 48, the scan driving unit 52 supplies the scan pulses to the scan electrodes Y1 to Ym, which are divided into a first group including $i^{th}$ (i is 1, 5, 9, 13, . . . ) scan electrodes Yi, a second group including $(i+1)^{th}$ scan electrodes Yi+1, a third group including $(i+2)^{th}$ scan electrodes Yi+2, and a fourth group including $(i+3)^{th}$ scan electrodes Yi+3, as shown in FIGS. 10*a* to 10*d*, under the control of the waveform generator 48.

At this time, the scan driving unit 52 sequentially supplies the scan pulses to the scan electrodes respectively included in the first group, the second group, the third group and the fourth group (second dividing scan, S212).

The second control signal is applied to the data alignment unit 46, which supplies corresponding data to the data driving unit 50 when the scan pulses are provided to the scan electrodes Yi included in the first group, and corresponding data to the data driving unit 50 when the scan pulses are provided to the scan electrodes Yi+1 included in the second group. Further, the data alignment unit 46 supplies corresponding data to the data driving unit 50 when the scan pulses are provided to the scan electrodes Yi+2 included in the third group, and corresponding data to the data driving unit 50 when the scan pulses are provided to the scan electrodes Yi+3 included in the fourth group. The data driving unit 50 converts the supplied data whenever the scan pulses are supplied as the data signals, and provides the converted data signals to the data electrodes X1 to Xn.

Figure 11A:
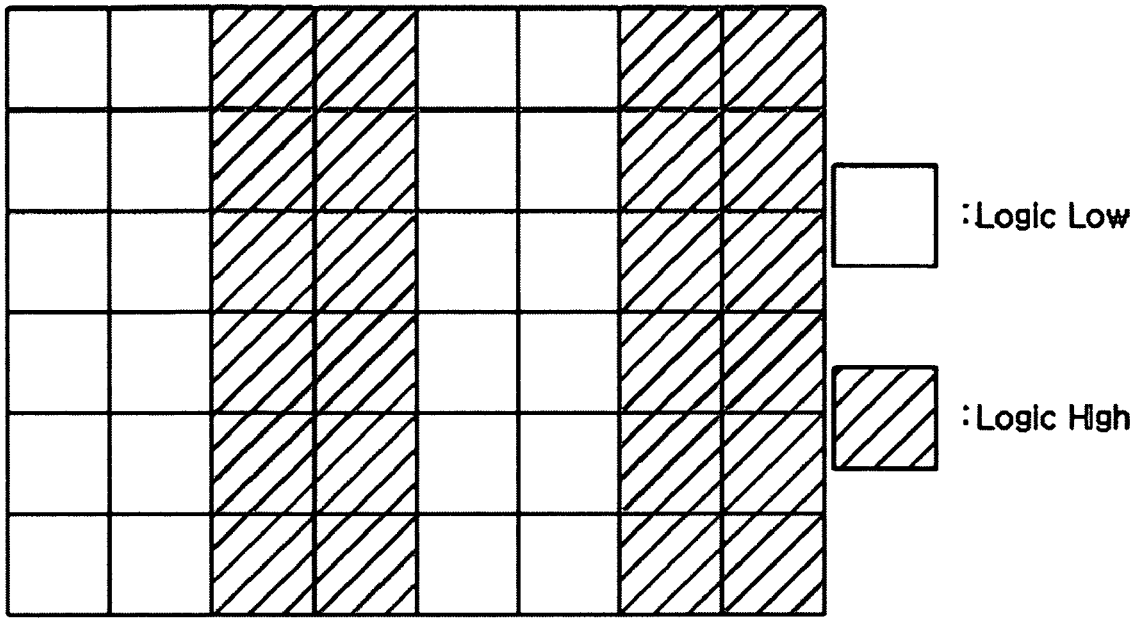
FIGS. 11*a* and 11*b* illustrate the polarity of data supplied to the panel for the operational process shown in FIGS. 10*a* and 10*b.*
Figure 11B:
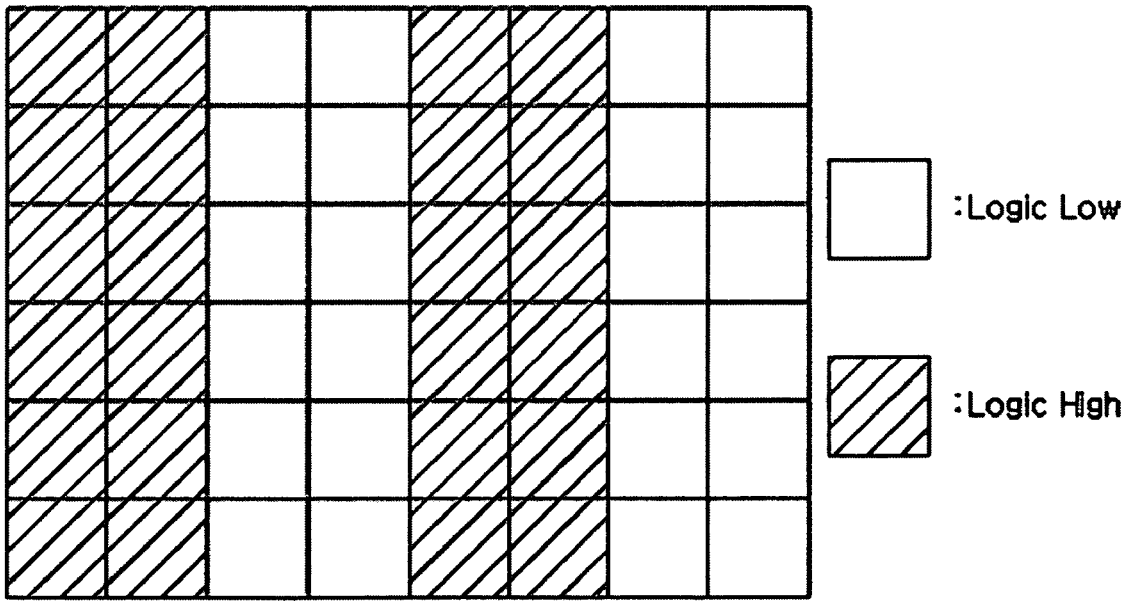

Accordingly, as shown in FIGS. 10*a* to 10*d*, when the scan pulses are supplied to the scan electrodes included in each group, data signals of the same polarity are provided to the data electrodes X1 to Xn, respectively. That is, in the present invention, as shown in FIGS. 11*a* and 11*b*, the polarity of the data signals is maintained without being changed for every horizontal signal. The present invention enables the polarity of the data signals supplied to the data electrodes X1 to Xn to change only when the scan pulses are provided to the first $(i+1)^{th}$ scan electrode Yi+1, the first $(i+2)^{th}$ scan electrode Yi+2 and the first $(i+3)^{th}$ scan electrode Yi+3, but remains constant otherwise through the scanning of the respective group. Actually, in this embodiment, it is possible that the first two groups of scan electrodes are scanned and then the polarity is changed for the scan of the last two groups of electrodes.

That is, in the present invention, the switching elements of the data driving unit 50 are maintained in the same on or off state when the scan pulses are supplied to the scan electrodes respectively included in the first, second, third, and fourth groups. Accordingly, power consumption and heat generated in the data driving unit 50 can be reduced or prevented.

Meanwhile, if the second data pattern is not detected in step S208, the data pattern detector 45 supplies a corresponding result to the data load detector 100, and the data load detector 100 also applies a third control signal to the data alignment unit 46 and the waveform generator 48. Further, if it is determined that the second data pattern is lower than the second reference point in step S210, the data load detector 100 applies the third control signal to the data alignment unit 46 and the waveform generator 48. The waveform generator 48 controls the scan driving unit 52 so that the scan pulses are, for example, sequentially supplied. Moreover, the data alignment unit 46 receiving the third control signal determines the supply sequence of data supplied such that it corresponds to the scan sequence of the scan driving unit 52, and supplies data corresponding to the decided supply sequence to the data driving unit 50. If necessary, additional data patterns can be detected and additional control signals can be provided for additional scan sequences.

As described above, according to a data control method and apparatus in accordance with the present invention, the load of data supplied as a first data pattern and a second data pattern is detected from a frame. Scan electrodes can be divided into two or more groups depending on the detected load of one or more predetermined data patterns, and are then supplied with scan signals that correspond to the divided groups. As such, if the scan electrodes are divided into two or more groups, variation in the polarity of data signals applied to data electrodes can be minimized. It is thus possible to reduce the power consumed and heat generated in a data integrated circuit.

Although particular first and second data patterns are described herein, the data control unit can detect and optimize scan sequences for any number or arrangement of data patterns. Moreover, data patterns can be detected and scan sequences can be provided for any portion of the panel or the entire panel. For example, the smallest portion of panel for which a pattern can be detected is two discharge cells.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A plasma display apparatus including scan electrodes, data electrodes intersecting the scan electrodes, and discharge cells at the intersections of the scan electrodes and the data electrodes, the apparatus comprising:

a scan driving unit that scans the scan electrodes in a scan sequence;

a data driving unit that supplies a data signal to the data electrodes; and a control unit for controlling the scan driving unit and the data driving unit, wherein the control unit detects at least one predetermined data pattern of input data and determines if a data load associated with the at least one data pattern exceeds a first reference point or a second reference point, and controls the scan sequence according to the data load, wherein the control unit detects at least two data patterns, the at least two data patterns includes at least one of a first data pattern in which a high level and a low level alternate in both a row direction and a column direction of the discharge cells, and a second data pattern in which a high level and a low level alternate in the row direction and alternate in groups of two in the column direction, wherein the control unit controls the scan driving unit to scan the scan electrodes in a first scan sequence if the data load of the first data pattern exceeds the first reference point, and the control unit controls the scan driving unit to scan the scan electrodes in a second scan sequence, different from the first scan sequence, if the data load of the second data pattern exceeds the second reference point, and wherein the first scan sequence is a sequence in which the scan electrodes are divided into two groups and then scanned and the second scan sequence is a sequence in which the scan electrodes are divided into four groups and then scanned.

2. The plasma display apparatus as claimed in claim 1, wherein the control unit comprises at least one of:

a data pattern detector for detecting the at least two data patterns of the input data;

a data load detector for detecting the data load of each of the at least two data patterns;

a waveform generator that controls the scan sequence of the scan electrodes in accordance with the data loads detected by the data load detector; and a data alignment unit that realigns data provided to the data electrodes based on the scan sequence.

3. The plasma display apparatus as claimed in claim 1, wherein the first reference point is different from the second reference point.

4. The plasma display apparatus as claimed in claim 1, wherein the first reference point is 25% of total data.

5. The plasma display apparatus as claimed in claim 1, wherein the second reference point is 50% of total data.

6. The plasma display apparatus as claimed in claim 1, wherein, in the first scan sequence, the scan electrodes are divided into a first group including odd-numbered scan electrodes and a second group including even-numbered scan electrodes.

7. The plasma display apparatus as claimed in claim 6, wherein, in the first scan sequence, the scan electrodes included in the first group are sequentially scanned and then the scan electrodes included in the second group are sequentially scanned.

8. The plasma display apparatus as claimed in claim 1, wherein, in the second scan sequence, the scan electrodes are divided into a first group including ith scan electrodes, i being 1,5,9,13, . . . m, a second group including (i+1)th scan electrodes, a third group including (i+2)th scan electrodes, and a fourth group including (i+3)th scan electrodes.

9. The plasma display apparatus as claimed in claim 8, wherein, in the second scan sequence, the scan electrodes included in the first group are sequentially scanned, the scan electrodes included in the second group are sequentially scanned, the scan electrodes included in the third group are sequentially scanned, and the scan electrodes included in the fourth group are sequentially scanned.

10. The plasma display apparatus as claimed in claim 1, wherein the control unit determines whether the at least one data pattern is present for each sub-field.

11. A plasma display apparatus, comprising:

scan electrodes;

data electrodes intersecting the scan electrodes;

a scan driving unit that scans the scan electrodes in a scan sequence depending upon a data load associated with a pattern over a portion of at least two scan electrodes;

a data driving unit that supplies a data signal corresponding to the scan to the data electrodes; and a control unit for controlling the scan driving unit and the data driving unit, wherein the control unit detects at least one predetermined data pattern of input data and determines if a data load associated with the at least one data pattern exceeds a first reference point or a second reference point, and controls the scan sequence according to the data load, wherein the control unit detects at least two data patterns, the at least two data patterns includes at least one of a first data pattern in which a high level and a low level alternate in both a row direction and a column direction of the discharge cells, and a second data pattern in which a high level and a low level alternate in the row direction and alternate in groups of two in the column direction, wherein the control unit controls the scan driving unit to scan the scan electrodes in a first scan sequence if the data load of the first data pattern exceeds the first reference point, and the control unit controls the scan driving unit to scan the scan electrodes in a second scan sequence, different from the first scan sequence, if the data load of the second data pattern exceeds the second reference point, and wherein the first scan sequence is a sequence in which the scan electrodes are divided into two groups and then scanned and the second scan sequence is a sequence in which the scan electrodes are divided into four groups and then scanned.

12. The plasma display apparatus of claim 11, wherein the at least two scan electrodes are adjacent scan electrodes.

13. A method of driving a plasma display apparatus including scan electrodes, and data electrodes intersecting the scan electrodes, comprising the steps of:

detecting at least one predetermined data pattern of input data and determining if a data load associated with the at least one data pattern exceeds a first reference point or a second reference point, and controlling a scan sequence according to the data load;

scanning the scan electrodes in the scan sequence depending upon the data load of at least two scan electrodes; and supplying a data signal corresponding to the scan sequence to the data electrodes, wherein the detecting is to detect at least two data patterns, the at least two data patterns includes at least one of a first data pattern in which a high level and a low level alternate in both a row direction and a column direction of the discharge cells, and a second data pattern in which a high level and a low level alternate in the row direction and alternate in groups of two in the column direction, wherein the controlling is to control the scan electrodes in a first scan sequence if the data load of the first data pattern exceeds the first reference point, and the controlling is to control the scan electrodes in a second scan sequence, different from the first scan sequence, if the data load of the second data pattern exceeds the second reference point, and wherein the first scan sequence is a sequence in which the scan electrodes are divided into two groups and then scanned and the second scan sequence is a sequence in which the scan electrodes are divided into four groups and then scanned.

* * * * *

UNITED STATES PATENT AND TRADEMARK OFFICE

CERTIFICATE OF CORRECTION

PATENT NO. : 7,598,931 B2
APPLICATION NO. : 11/166093
DATED : October 6, 2009
INVENTOR(S) : Jung Gwan Han It is certified that error appears in the above-identified patent and that said Letters Patent is hereby corrected as shown below:

On the Title Page Item (54), delete "SCAN DRIVING CONTROL OF A PLASMA DISPLAY ACCORDING TO A PREDETERMINED DATA PATTERN" and insert therefor --PLASMA DISPLAY APPARATUS AND METHOD OF DRIVING THEREOF--.

Signed and Sealed this

Twenty-fourth Day of November, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,598,931 B2
APPLICATION NO. : 11/166093
DATED : October 6, 2009
INVENTOR(S) : Jung Gwan Han It is certified that error appears in the above-identified patent and that said Letters Patent is hereby corrected as shown below:

On the Title Page Item (54) and Column 1, lines 1-3, delete "SCAN DRIVING CONTROL OF A PLASMA DISPLAY ACCORDING TO A PREDETERMINED DATA PATTERN" and insert therefor --PLASMA DISPLAY APPARATUS AND METHOD OF DRIVING THEREOF--.

This certificate supersedes the Certificate of Correction issued November 24, 2009.

Signed and Sealed this

Fifteenth Day of December, 2009

David J. Kappos

David J. Kappos
*Director of the United States Patent and Trademark Office*